US009410716B2

(12) United States Patent
Ryu

(10) Patent No.: US 9,410,716 B2
(45) Date of Patent: Aug. 9, 2016

(54) VENTILATION APPARATUS

(75) Inventor: Jeongtae Ryu, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 812 days.

(21) Appl. No.: 13/602,560

(22) Filed: Sep. 4, 2012

(65) Prior Publication Data

US 2013/0059523 A1 Mar. 7, 2013
US 2016/0195298 A9 Jul. 7, 2016

Related U.S. Application Data

(63) Continuation-in-part of application No. 13/597,476, filed on Aug. 29, 2012, now abandoned.

(30) Foreign Application Priority Data

Sep. 1, 2011 (KR) ..... 10-2011-0088645
Sep. 14, 2011 (KR) ..... 10-2011-0092643

(51) Int. Cl.

*F24F 7/06* (2006.01)
*F24F 7/007* (2006.01)
*F24F 13/20* (2006.01)
*F24F 1/00* (2011.01)

(52) U.S. Cl.

CPC ..... *F24F 13/20* (2013.01); *F24F 1/0007* (2013.01); *F24F 1/0033* (2013.01); *F24F 2001/004* (2013.01)

(58) Field of Classification Search

CPC ..... F24F 12/006
See application file for complete search history.

(56) References Cited

U.S. PATENT DOCUMENTS 2,331,691 A * 10/1943 Hubbard ..... F24F 1/0007 165/124
4,711,293 A * 12/1987 Niwa ..... F24F 12/001 165/10
4,787,210 A * 11/1988 Brown ..... 62/89
5,125,239 A * 6/1992 Kobayashi et al. ..... 62/262
5,632,334 A * 5/1997 Grinbergs ..... F24F 12/006 165/232

(Continued)

FOREIGN PATENT DOCUMENTS

JP 10-318578 A 12/1998
KR 10-0684257 B1 2/2007

(Continued)

OTHER PUBLICATIONS

Korean Notice of Allowance dated Oct. 16, 2012 issued in Application No. 10-2011-0088645.

*Primary Examiner* — Steven B McAllister
*Assistant Examiner* — Jonathan Cotov
(74) *Attorney, Agent, or Firm* — Ked & Associates LLP

(57) ABSTRACT

A ventilation apparatus is provided. The ventilation apparatus may include a base, frames positioned on the base, a rear panel positioned behind the frames and having an interior air discharge port and exterior air suction port formed therein, a top cover positioned on top of the frame and having exterior air discharge port formed therein, and a front panel positioned in front of the frames and having an interior air discharge port formed therein. Heat exchangers disposed in the frames may include interior and exterior air passages. An exhaust fan and air supply fans provide for air flow through the apparatus, guide by the frames. Use of the frames to guide air flow simplify structures and may enhance efficiency by simplifying the passages of the exterior and interior air through the apparatus.

20 Claims, 9 Drawing Sheets

(56) References Cited

U.S. PATENT DOCUMENTS

| | | | | |
|---|---|---|---|---|
| 6,612,365 | B1 * | 9/2003 | Saishu | F24F 12/006 165/164 |
| 6,637,232 | B1 * | 10/2003 | Harshberger | F24F 1/0007 165/122 |
| 7,802,443 | B2 * | 9/2010 | Wetzel | 62/262 |
| 2005/0235678 | A1 * | 10/2005 | Lee et al. | 62/412 |
| 2005/0269057 | A1 * | 12/2005 | Lee et al. | 165/9.3 |
| 2006/0021742 | A1 * | 2/2006 | Lee et al. | 165/122 |
| 2007/0155303 | A1 * | 7/2007 | Choi et al. | 454/258 |
| 2007/0158049 | A1 * | 7/2007 | Kim et al. | 165/48.1 |
| 2007/0170827 | A1 * | 7/2007 | Frenia et al. | 312/265.5 |
| 2008/0085437 | A1 * | 4/2008 | Dean et al. | 429/26 |
| 2008/0105418 | A1 * | 5/2008 | Takada et al. | 165/166 |
| 2008/0156470 | A1 * | 7/2008 | Lee et al. | 165/166 |
| 2008/0156471 | A1 * | 7/2008 | Han et al. | 165/166 |
| 2008/0302120 | A1 * | 12/2008 | Kang et al. | 62/259.1 |
| 2010/0293907 | A1 * | 11/2010 | Zheng et al. | 55/337 |
| 2011/0036541 | A1 * | 2/2011 | Takada et al. | 165/59 |
| 2013/0025822 | A1 * | 1/2013 | Ryu | 165/67 |

FOREIGN PATENT DOCUMENTS

| | | | |
|---|---|---|---|
| KR | 100684257 | * | 2/2007 |
| KR | 10-1042999 | B1 | 6/2011 |
| KR | 101042999 | * | 6/2011 |
| KR | 10-1117229 | B1 | 3/2012 |

* cited by examiner

VENTILATION APPARATUS

CROSS-REFERENCE TO RELATED APPLICATION(S)

This application is a Continuation-In-Part of prior U.S. patent application Ser. No. 13/597,476, which claims priority under 35 U.S.C. §119 to Korean Application No. 10-2011-0088645 filed on Sep. 1, 2011 and 10-2011-0092643 filed on Sep. 14, 2011, whose entire disclosures are hereby incorporated by reference.

BACKGROUND

1. Field

This relates to a ventilation apparatus.

2. Background

In general, a ventilation apparatus may supply exterior air to an interior space and exhaust interior air to the exterior, and may minimize interior heat loss by performing heat-exchange between the interior air and the exterior air. Such a ventilation apparatus may include an exhausting blower exhausting interior air to the exterior, an air-supplying blower supplying exterior air to the interior, and a heat transfer heat exchanger performing heat-exchange between the interior air exhausted by the exhausting blower and the exterior air air-supplied by the air-supplying blower. Such a ventilation apparatus may be, for example, embedded into a ceiling, with a ceiling insert type ventilation apparatus connecting the interior and the exterior by ducts to exhaust the interior air to the exterior through the ducts and to supply the exterior air to the interior through the ducts.

BRIEF DESCRIPTION OF THE DRAWINGS

The embodiments will be described in detail with reference to the following drawings in which like reference numerals refer to like elements wherein.

DETAILED DESCRIPTION

Figure 1:
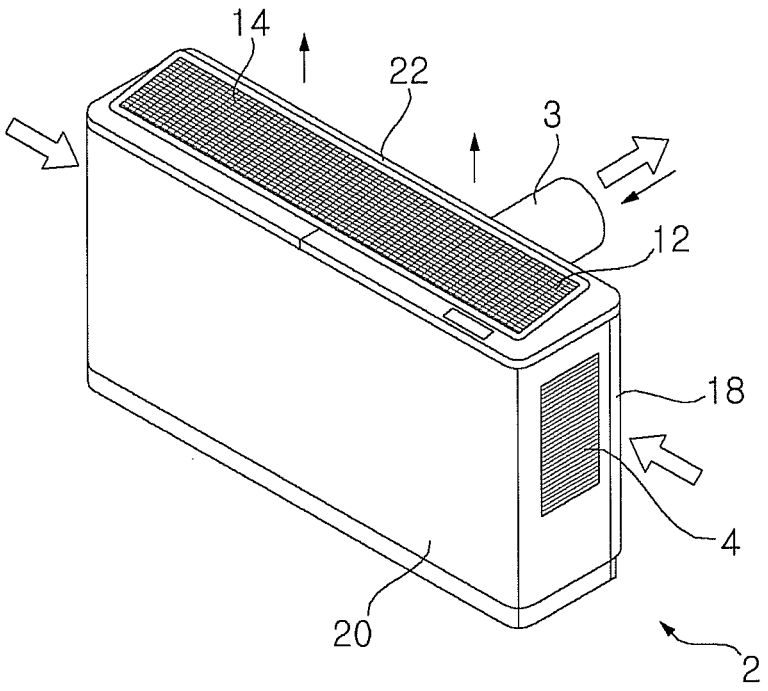
FIG. 1 is a perspective view of a ventilation apparatus in accordance with an embodiment as broadly described herein.

A ventilation apparatus in accordance with the embodiment shown in FIGS. 1-5 may include a casing 2 that defines an exterior of the apparatus thereof. The ventilation apparatus may be positioned in a space to be ventilated and may be connected to the exterior by a ventilating duct 3. The ventilating duct 3 may provide for communication between an interior and an exterior of the casing 2. The ventilating duct 3 may extend through a wall of a building. A partition 3' may be formed in the inside of the ventilating duct 3 to partition an air supply passage from an exhaust passage in the duct 3. The casing 2 may include interior air suction ports 4, 6, an interior air discharge port 8, an exterior air suction port 10 and exterior air discharge ports 12, 14. The ventilation apparatus may suction interior air in through the interior air suction ports 4, 6 and may discharge the suctioned interior air to the exterior through the ventilation duct 3. The ventilation apparatus may suction exterior air in through the ventilation duct 3 and may discharge the suctioned exterior air into the interior through the exterior air discharge ports 12, 14.

The casing 2 may include a base 16, a rear panel 18, a front panel 20, and a top cover 22.

The base 16 may define a bottom surface of the ventilation apparatus. The base 16 may include a bottom plate 16A, a left plate 16B that protrudes upward from a left end of the bottom plate 16A, and a right plate 16*c* that protrudes upward from a right end of the bottom plate 16A. An adjusting leg 17 including a screw portion and a bracket supporting the screw portion may be provided at the base 16. When the screw portion is turned in one direction, such as, for example, rotated clockwise or counterclockwise, the bracket moves away from the base 16 to adjust (increase) a height of the ventilation apparatus. Inversely, when the screw portion is turned in the opposite direction, the bracket and the base 16 approach each other to adjust (decrease) the height of the ventilation apparatus.

Figure 4:
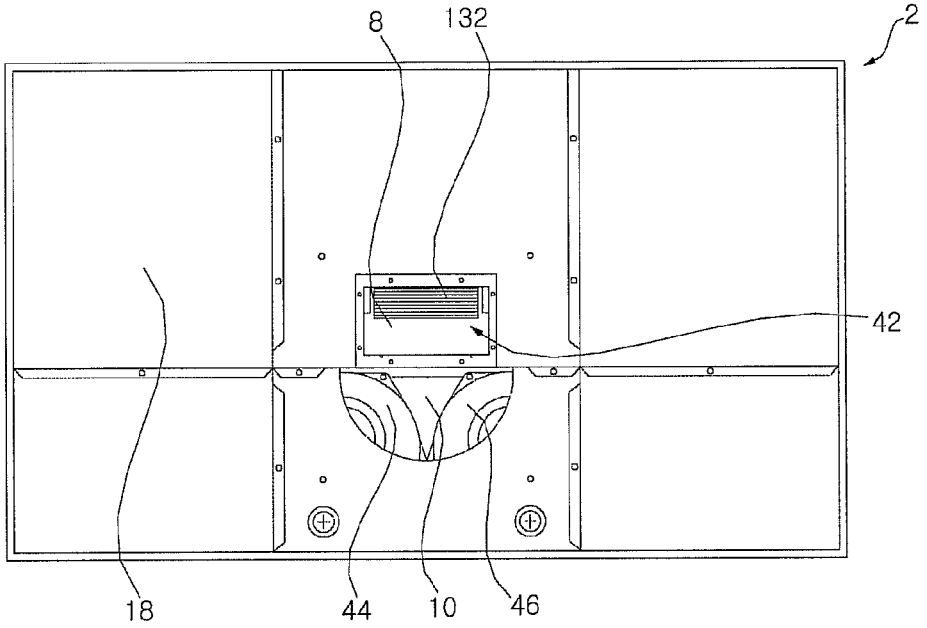
FIG. 4 is a rear interior view of the ventilation apparatus shown in FIGS. 1 and 2.

The rear panel 18 may define the back surface of the ventilation apparatus, with the interior air discharge port 8 and the exterior air suction port 10 extending therethrough. As shown in FIG. 4, the rear panel 18 may be formed so that the interior air discharge port 8 and the exterior air suction port 10 may be vertically spaced apart from each other. For example, the interior air discharge port 8 may be positioned above the exterior air suction port 10. The ventilation duct 3 may be connected to the rear panel 18 so that the exhaust passage formed above the partition 3' may communicate with the interior air discharge port 8 and the air supply passage formed below the partition 3' may communicate with the exterior air suction port 10.

The front panel 20 may define the front surface of the ventilation apparatus.

At least one of the rear panel 18 or the front panel 20 may also include portions thereof that define the lateral side surfaces of the ventilation apparatus. In one embodiment, the rear panel 18 may define the back surface of the ventilation apparatus, and the front panel 20 may define the front surface and both lateral side surfaces of the ventilation apparatus. However, in alternative embodiments, the rear panel 18 may define the back surface and both lateral side surfaces of the ventilation apparatus, and the front panel 20 may define the front surface of the ventilation apparatus. Alternatively, the rear panel 18 may define the back surface of the ventilation apparatus, the front panel 20 may define the front surface of the ventilation apparatus, and portions of the rear panel 18 and the front panel 20 may together define the two lateral side surfaces of the ventilation apparatus.

The rear panel 18 may include a back plate 18A in which the interior air discharge port 8 and the exterior air suction port 10 are formed, a left plate 18B that protrudes forward from the left end of the back plate 18A, and a right plate 18C that protrudes forward from the right end of the back plate 18A. Further, the front panel 20 may include a front plate 20A, a left plate 20B that protrudes backward from the left end of the front plate 20A, and a right plate 20C that protrudes backward from the right end of the front plate 20A. The interior air suction ports 4, 6 may be formed in one of the left side surface and/or the right side surface of the casing 2. In particular, the interior air suction ports 4, 6 may be respectively formed in the left and right plate 18B, 18C of the rear panel 18, or in the left and right plate 20B, 20C of the front panel 20, depending on how the front panel 20 and the rear panel 18 are configured.

There may be a gap at an area where the front panel 20 contacts the rear panel 18. When a length of the left and right side plates 20B, 20C of the front panel 20 in the front and back direction is greater than a length of the left and right side plates 18B, 18C of the rear panel 18 in the front and back direction, a gap between the rear panel 18 and the front panel 20 is not easily seen or noticed in the interior space in which the ventilation apparatus is installed. Thus, in the exemplary embodiment shown in FIGS. 1-5, the left and right side plates 20B, 20C of the front panel 20 are formed longer in the front and back direction than the left and right side plates 18B, 18C of the rear panel 18, and the interior air suction ports 4, 6 are formed in the left and right plates 20B, 20C of the front panel 20.

The interior air suction ports 4, 6 may be formed at positions corresponding to interior air passages 38, 39 to be described later.

A top cover 22 may define a top surface of the ventilation apparatus. The top cover 22 may have the exterior air discharge ports 12, 14 formed therein.

Heat transfer heat exchangers 32, 34 may be installed in the casing 2 to perform heat-exchange between the interior air to be exhausted to the exterior and the exterior air to be supplied to the interior. The heat exchangers 32, 34 may have exterior air passages 36, 37 to guide the flow of the exterior air and interior air passages 38, 39 to guide the flow of the interior air.

The exterior air passages 36, 37 may extend in one direction, for example, vertically. The heat transfer heat exchangers 32, 34 may be disposed so that the exterior air is introduced into the bottom surface of the exterior air passages 36, 37 and discharged at the top surface of the exterior air passages 36, 37. The interior air passages 38, 39 may extend in another direction, for example, horizontally. The heat transfer heat exchangers 32, 34 may be disposed so that the interior air is introduced into one of the left or the right side surface thereof and discharged at the other of the left or the right side surface thereof.

A front shield member may be positioned at front surfaces of the heat exchangers 32, 34, and a rear shield member may be positioned at rear surfaces of the heat exchangers 32, 34. A plurality of heat transfer members may be disposed between the front shield member and the rear shield member to facilitate heat exchange between the exterior air and the interior air while also partitioning the exterior air passages 36, 37 and the interior air passages 38, 39.

The exterior air passages 36, 37 and the interior air passages 38, 39 may be alternately formed in the front and back direction. The left and right surfaces of the exterior air passages 36, 37 may be blocked, and the top and bottom surfaces thereof may be opened. The top and bottom surfaces of the interior air passages 38, 39 may be blocked, and the left and right surfaces thereof may be opened.

An exhaust fan 42 may draw the interior air into the interior air passages 38, 39, and air supply fans 44, 46 may draw the exterior air into the exterior air passages 36, 37.

The exhaust fan 42 suctions the interior air into the interior air suction ports 4, 6, through the interior air passages 38, 39 of the heat transfer heat exchangers 32, 34 horizontally, and then, may discharge the interior air through the interior air discharge port 8. The air supply fans 44, 46 suction the exterior air into the exterior air suction port 10, through the exterior air passages 36, 37 of the heat transfer heat exchangers 32, 34 vertically, and then, may discharge the exterior air through the exterior air discharge ports 12, 14.

A frame 50, in which at least one of the heat exchangers 32, 34, the exhaust fan 42 and/or the air supply fans 44, 46 is disposed, may be provided in the inside of the casing 2. The frame 50 may be disposed on top of the base 16, with the rear panel 18 behind the frame 50, the front panel 20 in the front of the frame 50 and the top cover 22 on top of the frame 50. In certain embodiments, the heat exchangers 32, 34 may be disposed in the frame 50 and the exhaust fan 42 may be positioned next to the heat exchangers 32, 34, in the rear panel 18, with the air supply fans 44, 46 positioned in the frame 50.

The frame 50 may include lower frames 52, 54, vertical frames 80, 82, and upper frames 84, 86. The heat exchangers 32, 34 may be fixed into the lower frames 52, 54, vertical frames 80, 82, and upper frames 84, 86. In particular, the heat exchangers 32, 34 may be seated on the lower frames 52, 54, and the vertical frames 80, 82 and the upper frames 84, 86 may limit movement of the heat exchangers 32, 34 seated on the lower frames 52, 54.

The frame 50 may form exterior air suction passages 56, 58 between the heat exchangers 32, 34 and the base 16.

The lower frames 52, 54 may allow the bottom surfaces of the heat exchangers 32, 34 to be spaced apart from the base 16. The lower frames 52, 54 may define the exterior air suction passages 56, 58 together with the bottom surface of the heat exchangers 32, 34 and the bottom plate 16A of the base 16. The exterior air blown from the air supply fans 44, 46 passes through the exterior air suction passages 56, 58 and may be moved into the exterior air passages of the heat exchangers 32, 34. The lower frames 52, 54 may form openings 60, 62 that guide the exterior air blown from the air supply fans 44, 46 to the exterior air passages 36, 37. The openings 60, 62 may be formed in the bottom of the heat exchanger 32, 34. The lower frames 52, 54 may include first lower horizontal frames 64, 66 disposed on the bottom plate 16A of the base 16 and second lower horizontal frames 68, 70 vertically spaced apart from the first lower horizontal frames 64, 66. The lower frames 52, 54 may also include first lower connecting frames 72, 74 connecting one end of the first lower horizontal frames 64, 66 to a corresponding end of the second lower horizontal frames 72, 74 and second lower connecting frames 76, 78 connecting the other end of the first lower horizontal frames 64, 66 to a corresponding end to a corresponding end of the second lower horizontal frames 68, 70.

The vertical frames 80, 82 may be arranged vertically with respect to the lower frames 52, 54. The vertical frames 80, 82 may form openings 81, 83 that guide the interior air from the interior air passages 38, 39 to the exhaust fan 42.

The upper frames 84, 86 may be disposed on top of the vertical frames 80, 82. The upper frames 84, 86 may form openings 85, 87 that guide the exterior air from the exterior air passages 36, 37 into the interior space.

The ventilation apparatus may include interior air filters 88, 90 positioned between the interior air suction ports 4, 6 and the interior air passages 38, 39. The interior air filters 88, 90 may filter the interior air suctioned into the interior air passages 38, 39 and prevent foreign substances from entering into the interior air passages 38, 39 of the heat transfer heat exchangers 32, 34. If, for example, the interior air is suctioned through the left surfaces of the heat exchangers 32, 34, the interior air filters 88, 89 may be positioned between the left surfaces of the heat exchangers 32, 34 and the interior air suction ports 4, 6. If instead the interior air is suctioned through the right surfaces of the heat exchangers 32, 34, the interior air filters 88, 90 may be positioned between the right surfaces of the heat exchangers 32, 34 and the interior air suction ports 4, 6.

The frame 50 may include filter frames 92, 94 to which the interior air filters 88, 90 may be attached/detached. The filter frames 92, 94 may include openings 91, 93 that guide interior air toward the interior air passages 38, 39. The filter frames 92, 94 may include filter guides 96, 98 that slidably receive and guide movement of the interior air filters 88, 90 in the front and back direction. The filter frames 92, 94 may connect the lower frames 52, 54 and the upper frames 84, 86. The heat exchangers 32, 34 may be fixed by the filter frames 92, 94, the lower frames 52, 54, the vertical frames 80, 82, and the upper frames 84, 86.

The air supply fans 44, 46 may be positioned next to the lower frame 52. The frame 50 may further include air supply fan mounts 100, 102 in which the air supply fans 44, 46 are supported. The air supply fan mounts 100, 102 may be coupled with the lower frames 52, 54 and vertically positioned in the inside of the casing 2.

The frame 50 may also include a partition plate 112 that partitions an exterior air suction chamber 108 in which the air supply fans 44, 46 are positioned, and an interior air exhaust chamber 110 in which the exhaust fan 42 is positioned. The partition plate 112 may prevent mixing of the interior air suctioned from the interior with the exterior air suctioned from the exterior. The exterior air suction chamber 108 may be formed between the bottom plate 16A of the base 16 and the partition plate 112. The interior air exhaust chamber 110 may be formed between the top cover 22 and the partition plate 112. The top surface of the partition plate 112 may form an interior air passage, and the bottom surface of the partition plate 112 may form an exterior air passage. The partition plate 112 may establish an installation space for the air supply fans 44, 46 while also allowing space for a maximum height of the heat exchangers 32, 34. The partition plate 112 may include a horizontal plate 114 positioned next to the heat exchangers 32, 34 and inclination plates 116, 118 extending at an incline from opposite edges of the horizontal plate 114 toward the bottom end of the heat exchangers 32, 34.

The frame 50 may include a shield plate 120 positioned between the exhaust fan 42 and the top cover 22 to prevent exterior air discharged at the top of the exterior air passages 36, 37 of the heat exchangers 32, 34 from flowing backward into the exhaust fan 42.

The ventilation apparatus may also include a controller 122 received on the shield plate 120 and controlling the exhaust fan 42 and the air supply fans 44, 46. The shield plate 120 may include a controller receiving space 121 defined by a bottom plate on which the controller 122 is mounted, side plates extending upward from the bottom plate and spaced apart from the heat exchanger holders 76, 78, and top plate extending outward from the respective side plates to the top of the heat exchanger holders 76, 78. The front surface of the controller receiving space 121 may remain open service of the controller 122.

Figure 2:
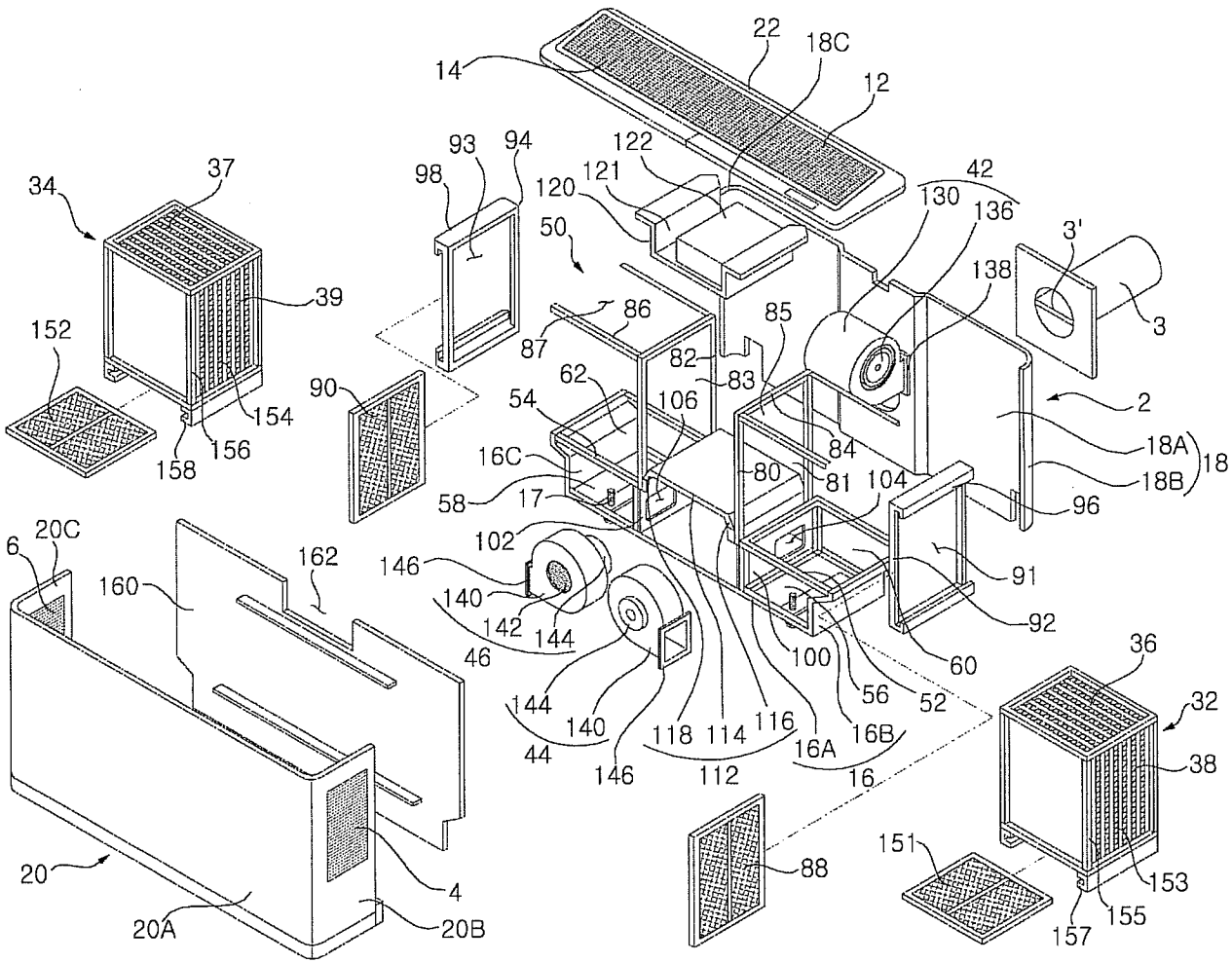
FIG. 2 is a disassembled perspective view of the ventilation apparatus shown in FIG. 1.
Figure 3:
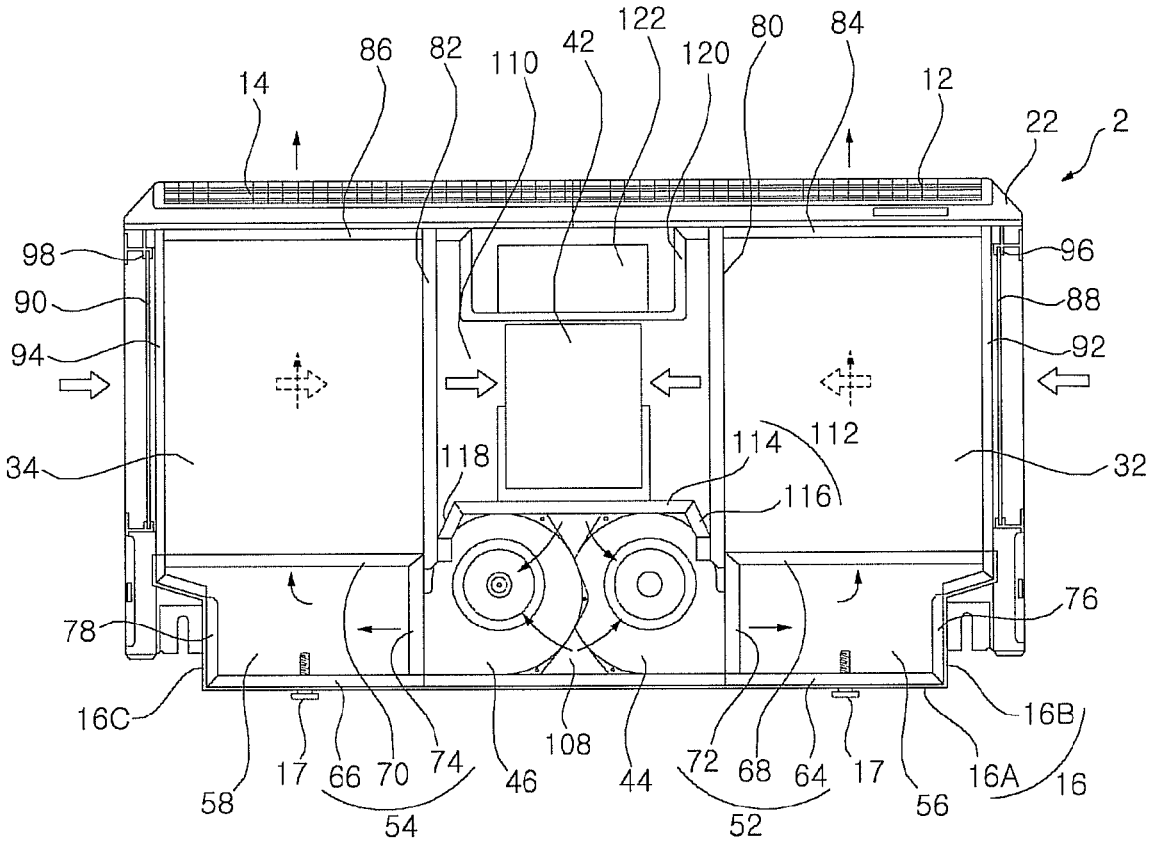
FIG. 3 is a front interior view of the ventilation apparatus shown in FIGS. 1 and 2.

As shown in FIG. 2, the exhaust fan 42 may include a fan housing 130, a blower 132 in the fan housing 130, and a motor 136 connected to the blower 132 by a rotation shaft. In certain embodiments, the fan housing 130 may be disposed in the rear panel 18. An air suction port suctioning the interior air into the inside of the fan housing 130 may be formed in each of the left and right surfaces thereof, and an air discharge port 138 discharging the interior air may protrude backward from the fan housing 130, in communication with the interior air discharge port 8.

As shown in FIG. 2, the air supply fans 44, 46 may each include a fan housing 140, a blower 142 rotating in the fan housing 140, and a motor 144 disposed in the fan housing 140 and rotating the blower 142. The fan housing 140 may be disposed in air supply fan mounts 100, 102 of the frame 50. An air suction port suctioning the exterior air into the inside of the fan housing 140 may be formed in each of the front and back surface thereof, and an air discharging port 146 discharging the exterior air may extend outward in a side direction from an outer circumferential thereof, excluding the front and rear surfaces of the fan housing 140 where air suction ports are formed.

The ventilation apparatus may include exterior air filters 151, 152 that filter the exterior air directed toward the exterior air passages 36, 37. The exterior air filters 151, 152 may be disposed at the bottom of the heat exchangers 32, 34 to prevent foreign substances from entering into the exterior air passages 36, 37 of the heat exchangers 32, 34. The exterior air filters 151, 152 may be disposed within the heat exchangers 32, 34, or provided on the lower frames 52, 54. Hereinafter, simply for ease of discussion it will be assumed that the exterior air filters 151, 152 are disposed in the heat exchangers 32, 34. The heat exchangers 32, 34 may include a plurality of heat transfer members 153, 154, heat transfer member frames 155, 156 respectively supporting the plurality of heat transfer members 153, 154, and exterior air filter guides 157, 158 in the bottom of the heat transfer member frames 155, 156 that allow the exterior air filters 151, 152 to be slidably detached, in a front and back direction, from the exterior air filter guides 157, 158.

The ventilation apparatus may include a service cover 160 coupled with the frame 50 and covering a front surface of the frame 50. When separating the front panel 20, the service cover 160 may remain in place so that the heat exchangers 32, 34, air supply fans 44, 46, and exhaust fan 42 are not exposed to the outside. The service cover 160 may be fastened to the frame 50 by fasteners such as, for example, screws. The filter frames 92, 94 may remain exposed with the service cover 160 installed on the frame 50 so that the interior air filters 88, 90 may be removed and replaced without separating the service cover 160. A groove 162 may be formed in front of the controller 122 to allow the controller 122 to be serviced without separating the service cover 160.

In a ventilation apparatus as embodied and broadly described herein, the heat exchangers 32, 34 may include the left heat exchanger 32 and the right heat exchanger 34 spaced apart from each other, side by side, in the inside of the casing 2, with the left air supply fan 44 moving exterior air into the left heat exchanger 32 and the right air supply fan 46 moving exterior air into the right heat exchanger 34.

The left interior air suction port 4 may be formed on the left lateral side of the front panel 20 corresponding to the left heat exchanger 32 and the right interior air suction port 6 may be formed on the right lateral side of the front panel 20 corresponding to the right heat exchanger 34.

The left exterior air discharge port 12 may be formed in the top cover 22 corresponding to the top of the left heat exchanger 32 and the right exterior air discharge port 14 may be formed in the top cover 22 corresponding to the top of the right heat exchanger 34.

In a ventilation apparatus as embodied and broadly described herein, the lower frames 52, 54 may include the left lower frame 52 on which the left heat exchanger 32 is seated and the right lower frame 54 on which the right heat exchanger 34 is seated, with the left vertical frame 80 supporting the right side of the left heat exchanger 32 and the right vertical frame 82 supporting the left side of the right heat exchanger 34, and the left upper frame 84 fixed to the top of the left heat exchanger 32 and the right upper frame 86 fixed to the top of the right heat exchanger 34.

The left filter frame 92 may be connected to the left lower frame 52 and the left upper frame 84, and the right filter frame 94 may be connected to the right lower frame 54 and the right upper frame 86.

In a ventilation apparatus as embodied and broadly described herein, the left interior air filter 88 may be provided at the left of the left heat exchanger 32 and the right interior air filter 90 may be provided at the right of the right heat exchanger 34.

The left of the partition plate 112 may be connected to at least one of the left lower frame 52 or the left vertical frame 80 and the right of the partition plate 112 may be connected to at least one of the right lower frame 54 or the right vertical frame 82.

The left of the shield plate 120 may be connected to at least one of the left vertical frame 80 or the left upper frame 80 and the right of the shield plate 120 may be connected to at least one of the right vertical frame 82 or the right upper frame 86.

The left exterior air filter 151 may be provided at the bottom of the left heat exchanger 32 and the right exterior air filter 152 may be provided at the bottom of the right heat exchanger 34.

Figure 5:
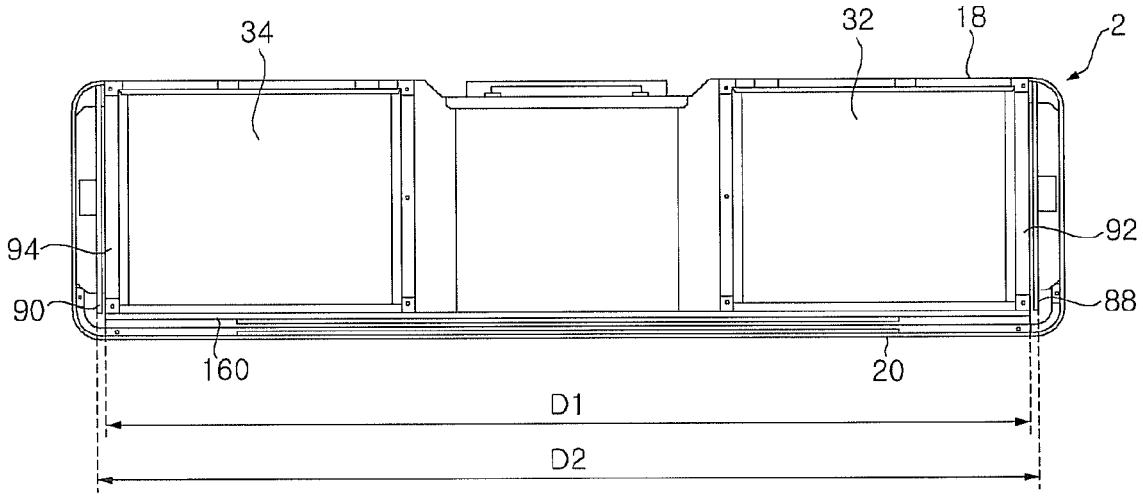
FIG. 5 is a plan view of a service cover and an interior air filter of the ventilation apparatus shown in FIGS. 1 and 2.

FIG. 5 is a plan view of a service cover and an interior air filter of the ventilation apparatus shown in FIGS. 1-4.

A width D1 of the service cover 160, between the left and right ends thereof, may be shorter than a separation distance D2 between the left interior air filter 88 in the left filter frame 92 and the right interior air filter 90 in the right filter frame 94.

When separating the front panel 20, the service cover 160, the left interior air filter 88, and the right interior air filter 90 may be exposed. The left interior air filter 88 may be withdrawn at the left end of the service cover 160 without separating the service cover 160 from the frame 50. Similarly, the right interior air filter 90 may be withdrawn at the right end of the service cover 160 without separating the service cover 160 from the frame 50.

Figure 6:
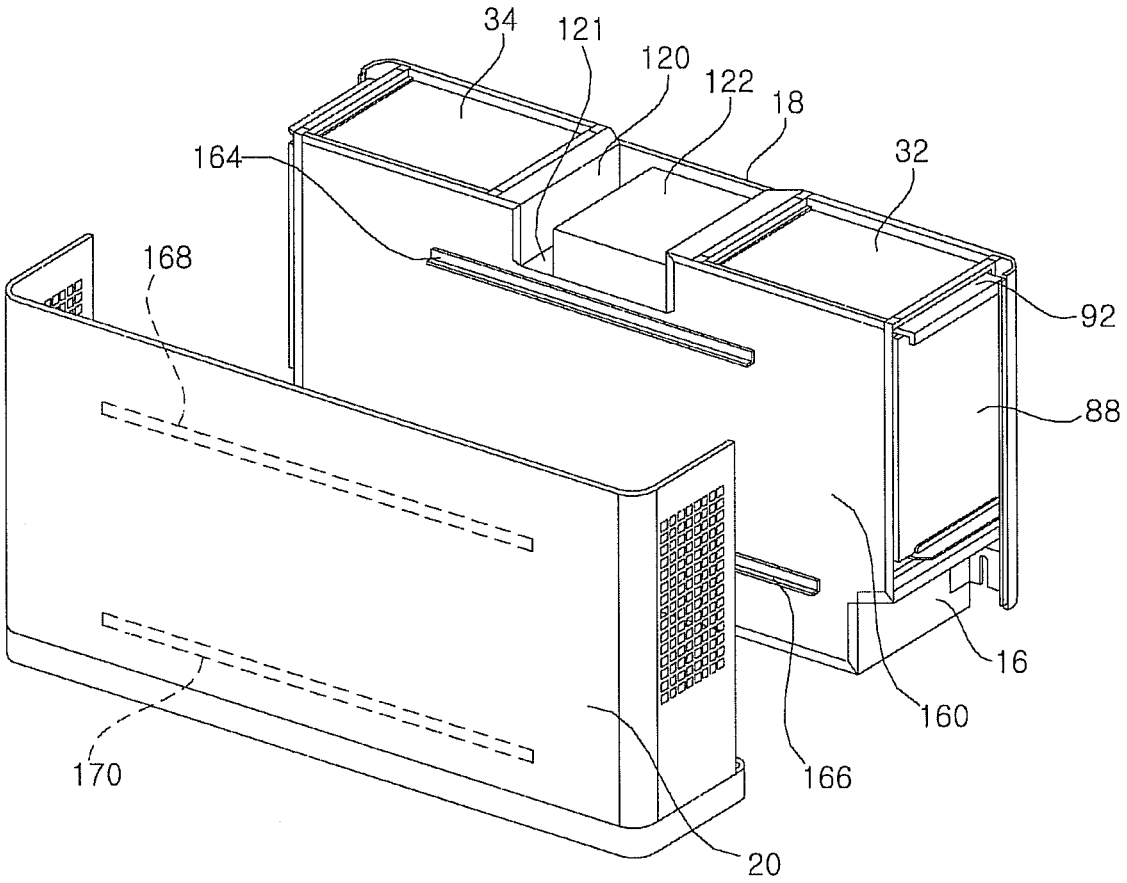
FIG. 6 is a disassembled perspective view of the ventilation apparatus having a front panel thereof separated therefrom.

As shown in the disassembled perspective view of FIG. 6, the ventilation apparatus may also include a plurality of cover brackets 164, 166 coupled to the service cover 160, and a plurality of panel brackets 168, 170 provided on the front panel 20. In the embodiment shown in FIG. 6, the plurality of cover brackets 164, 166 are disposed horizontally to reinforce strength of the service cover 160. The plurality of cover brackets 164, 166 may be fixed to the service cover 160 by fasteners such as, for example, screws, or by adhering means such as adhesives, or by welding such as spot welding. The plurality of cover brackets 164, 166 may include an upper cover bracket 164 provided closer to the top of the service cover 160 and a lower cover bracket 166 provided in parallel to the upper cover bracket 164 and closer to the bottom of the service cover 160.

The plurality of panel brackets 168, 170 may be positioned to correspond to the plurality of cover brackets 164, 166, such as, for example, horizontally to reinforce strength of the front panel 20, as shown in FIG. 6. When installing the front panel 20, the plurality of panel brackets 168, 170 may be inserted into the plurality of cover brackets 164, 166, thereby increasing the strength of the front panel 20 and the service cover 160 and preventing random separation of the front panel 20. The plurality of panel brackets 168, 170 may be fixed to the front panel 20 by the adhering means such as adhesives, or by welding such as the spot welding. The plurality of panel brackets 168, 170 may include an upper panel bracket 168 and a lower panel bracket 170, with the upper panel bracket 168 positioned near the upper cover bracket 164 to contact the upper cover bracket 164 and the lower panel bracket 170 positioned near the lower cover bracket 166 to contact the lower cover bracket 166.

In an alternative embodiment, a separation distance between the plurality of panel brackets 168, 170 may be larger than that between the plurality of cover brackets 164, 166 so that the plurality of cover brackets 164, 166 are positioned therebetween, or a separation distance between the plurality of panel brackets 168, 170 may be smaller than that between the plurality of cover brackets 164, 166 so that the plurality of panel brackets 168, 170 are positioned between the plurality of cover brackets 164, 166.

Operation of the ventilation apparatus configured as above will now be described.

First, when driving the air supply fans 44, 46, exterior air is suctioned into the exterior air suction chamber 108 through the exterior air suction port 10 and blown into the bottom of the heat exchangers 32, 34 by the air supply fans 44, 46. At this point, the moving direction is changed to an upward direction, and foreign substances are filtered from the exterior air by the exterior air filters 151, 152.

The exterior air passing through the exterior air filters 151, 152 is introduced into the exterior air passages 36, 37 through the bottom surface of the heat exchangers 32, 34, undergoes heat-exchange with the interior air passing through the interior air passages 38, 39, and is discharged through the top surface of the heat exchangers 32, 34. The exterior air discharged through the top surface of the heat exchangers 32, 34 is directly discharged into the interior space to be ventilated through the exterior air discharge ports 12, 14 of the top cover 22.

The moving direction of the exterior air is first horizontally converted in the exterior air suction chamber 108 and is then vertically converted at the bottom of the heat exchangers 32, 34. Therefore, after converting its moving direction twice, the heat-exchanged exterior air is discharged into the interior space.

When driving the exhaust fan 42, the interior air is suctioned from the interior space into the ventilation apparatus through the interior air suction ports 4, 6, where foreign substances are filtered from the interior air by the interior air filters 88, 90.

The interior air passing through the interior air filters 88, 90 undergoes heat-exchange with the exterior air in the exterior air passages 36, 37 while passing through the interior air passages 38, 39 of the heat exchangers 32, 34, is suctioned into the interior air exhaust chamber 110, through the exhaust fan 42, and is discharged to the outside through the interior air discharge port 8.

The moving direction of the interior air is horizontally converted in the interior air exhaust chamber 110. Therefore, after converting moving direction only once the interior air is discharged to the outside.

Figure 7:
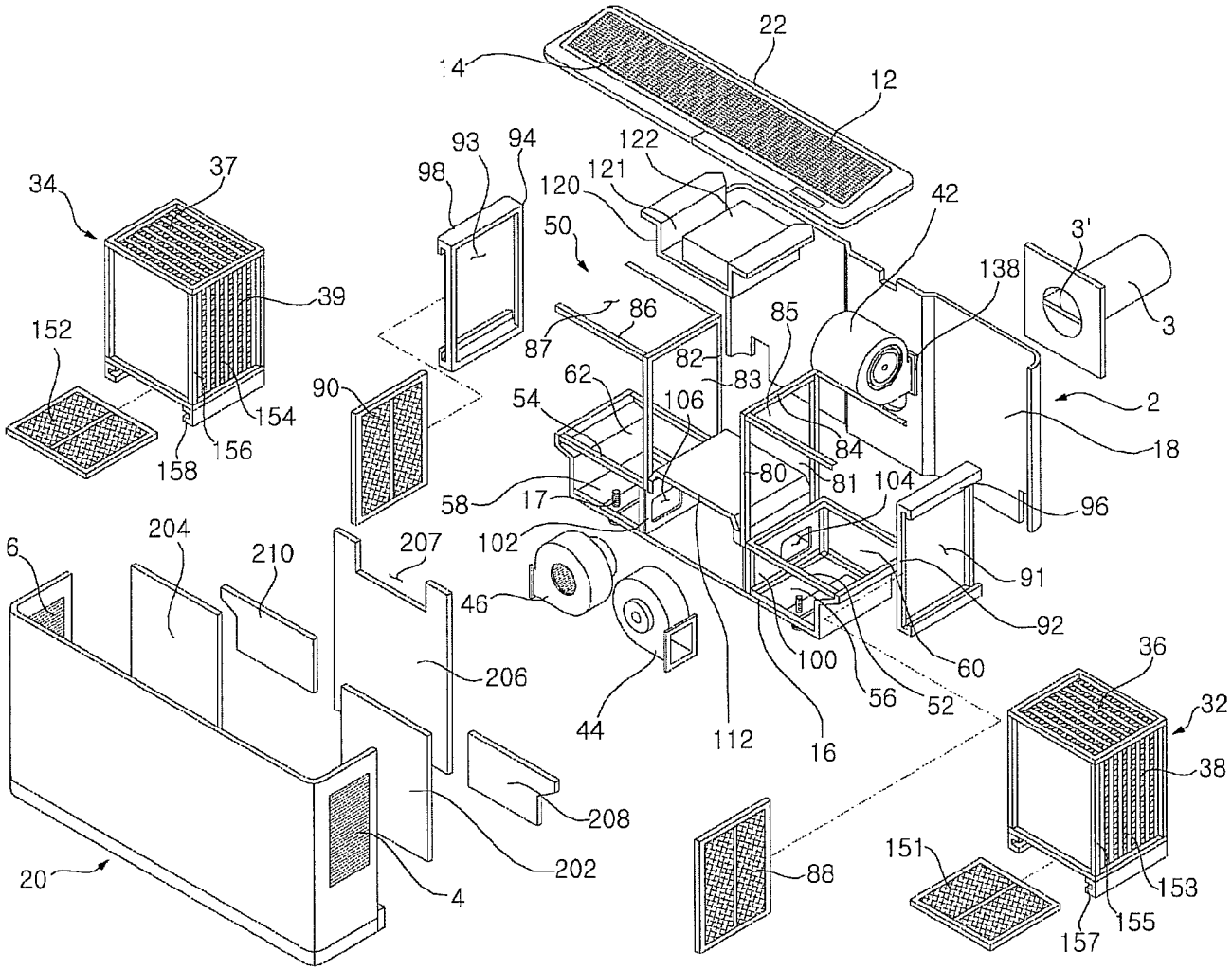
FIG. 7 is a disassembled perspective view of a ventilation apparatus in accordance with another embodiment as broadly described herein.
Figure 8:
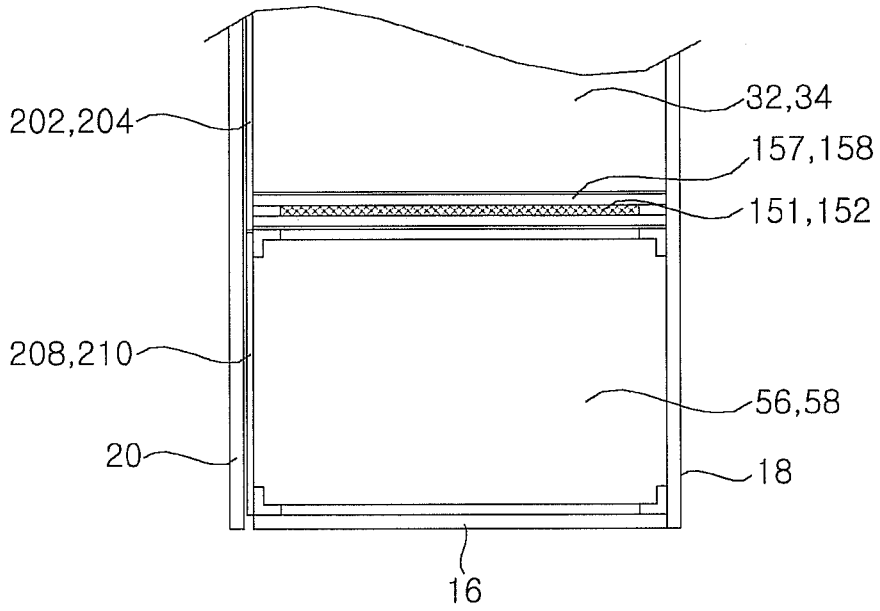
FIG. 8 is a cross sectional view of a plurality of service covers of the ventilation apparatus shown in FIG. 7.

FIG. 7 is a disassembled perspective view of a second embodiment of ventilation apparatus as broadly described herein, and FIG. 8 is a cross sectional view of service covers of the ventilation apparatus shown in FIG. 7.

As shown in FIGS. 7 and 8, a plurality of service covers 200, 202, 204, 206, 208 may be mounted on the frame 50 by fasteners, such as screws, and may be separated from the frame 50 by releasing the fasteners. The plurality of service covers may include first service covers 202, 204 shielding the front of the heat exchangers 32, 34, and a second service cover 206 shielding the fronts of the air supply fans 44, 46 and the exhaust fans 42.

The first service covers 202, 204 may prevent the exterior air blown from the air supply fans 44, 46 from leaking through the exterior air discharging ports 12, 14 through the fronts of the exterior air filters 151, 152 and the heat exchangers 32, 34. The exterior air blown from the air supply fans 44, 46 may be blocked by the first service covers 202, 204 and guided to the exterior air filters 151, 152 and the exterior air passages 36, 37 of the heat exchangers 32, 34 for discharge through the exterior air discharge ports 12, 14. The first service covers 202, 204 may prevent the exhaust fan 42 from suctioning interior air through the fronts of the heat exchangers 32, 34. Rather, the interior air suctioned by the exhaust fan 42 is blocked by the first service covers 202, 204 and guided to the interior air passages 38, 39 of the heat exchangers. The first service covers 202, 204 may cover the space between the ends of the vertical frames 80, 82 and the filter frames 92, 94 and may cover the space between the ends of the upper frames 84, 86 of the lower frames 52, 54. The first service covers 202, 204 may leave the front of the interior air filters 88, 90 exposed so that the interior air filters 88, 90 may be serviced without removing the first service covers 202, 204. The first service covers 202, 204 may include a first left service cover 202 detachably coupled to the frame 50 and shielding the front of the left heat exchanger 32, and a first right service cover 204 detachably coupled to the frame 50 and shielding the front of the right heat exchanger 34. The first service covers 202, 204 may shield the fronts of the heat exchangers 32, 34 and also the exterior air filters 151, 152.

The second service cover 206 may cover the space between the ends of the left lower frame 52 and the right lower frame 54, the space between the ends of the left vertical frame 80 and the right vertical frame 82, and the space between the ends of the left upper frame 84 and the right upper frame 86. The second service cover 206 may also cover the space between the ends of the base 16 and the shield plate 120. A groove 207 may be formed in the second service cover 206, in the front of the control box 122, so that the controller 122 may be serviced without removing the second service cover 206.

The plurality of service covers may further include third service covers 208, 210 detachably coupled to the frame 50 and shielding the front of the exterior air suction passages 56, 58. The third service covers 208, 210 may prevent the exterior air blown from the air supply fans 44, 46 from leaking into the exterior air discharge ports 12, 14 through the fronts of the exterior air suction passages 56, 58, the exterior air filters 151, 152, and the heat transfer heat exchangers 32, 34. The exterior air blown from the air supply fans 44, 46 is guided to the exterior air suction passages 56, 58, the exterior air filters 151, 152, and the exterior air passages 36, 37 of the heat exchangers 32, 34 for discharge through the exterior air discharge ports 12, 14. The third service covers 208, 210 may cover the front surface of the lower frames 52, 54. The third service covers 208, 210 may include a third left service cover 208 shielding the left exterior air suction passage 56 at the bottom of the left heat exchanger 32, and a third right service cover 210 shielding the right exterior air suction passage 58 at the bottom of the right heat exchanger 34. The third left service cover 208 may cover the front surface of the left lower frame 52, and the third right service cover 210 may cover the front surface of the right lower frame 54.

Figure 9:
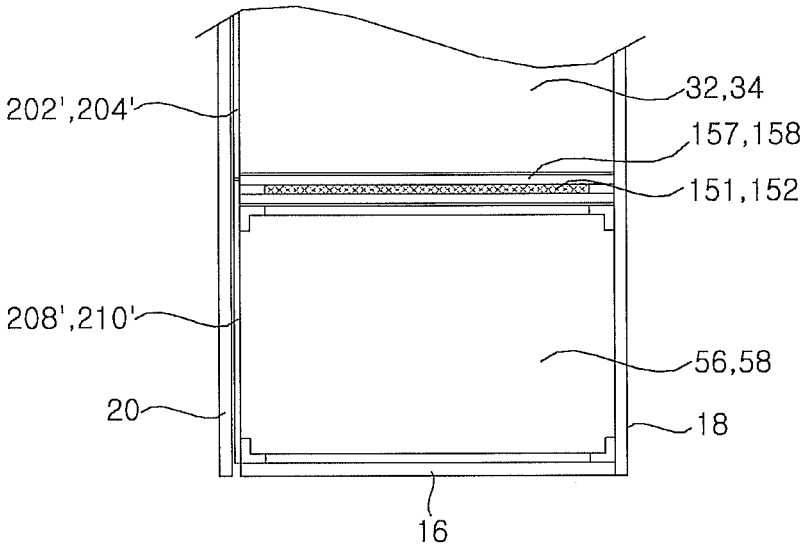
FIG. 9 is a cross sectional view of a plurality of service covers of a ventilation apparatus in accordance with another embodiment as broadly described herein.

FIG. 9 is a cross sectional of a plurality of service covers of a ventilation apparatus in accordance with a third embodiment.

As shown in FIG. 9, first service covers 202' and 204' may be detachably coupled to the frame 50 to shield the front of the heat transfer heat exchangers 32, 34 while leaving the front of the exterior air filters 151, 152 exposed. Third service covers 208' and 210' may be detachably coupled to the frame 50 to shield the fronts of the exterior air suction passages 56, 58 and also the exterior air filters 151, 152.

In this embodiment, to service the exterior air filters 151, 152, removal of the third service covers 208', 210', which are smaller in size, rather than the first service covers 202', 204', which are larger size, the exterior air filter 151, 152 may be more easily accessed.

Figure 10:
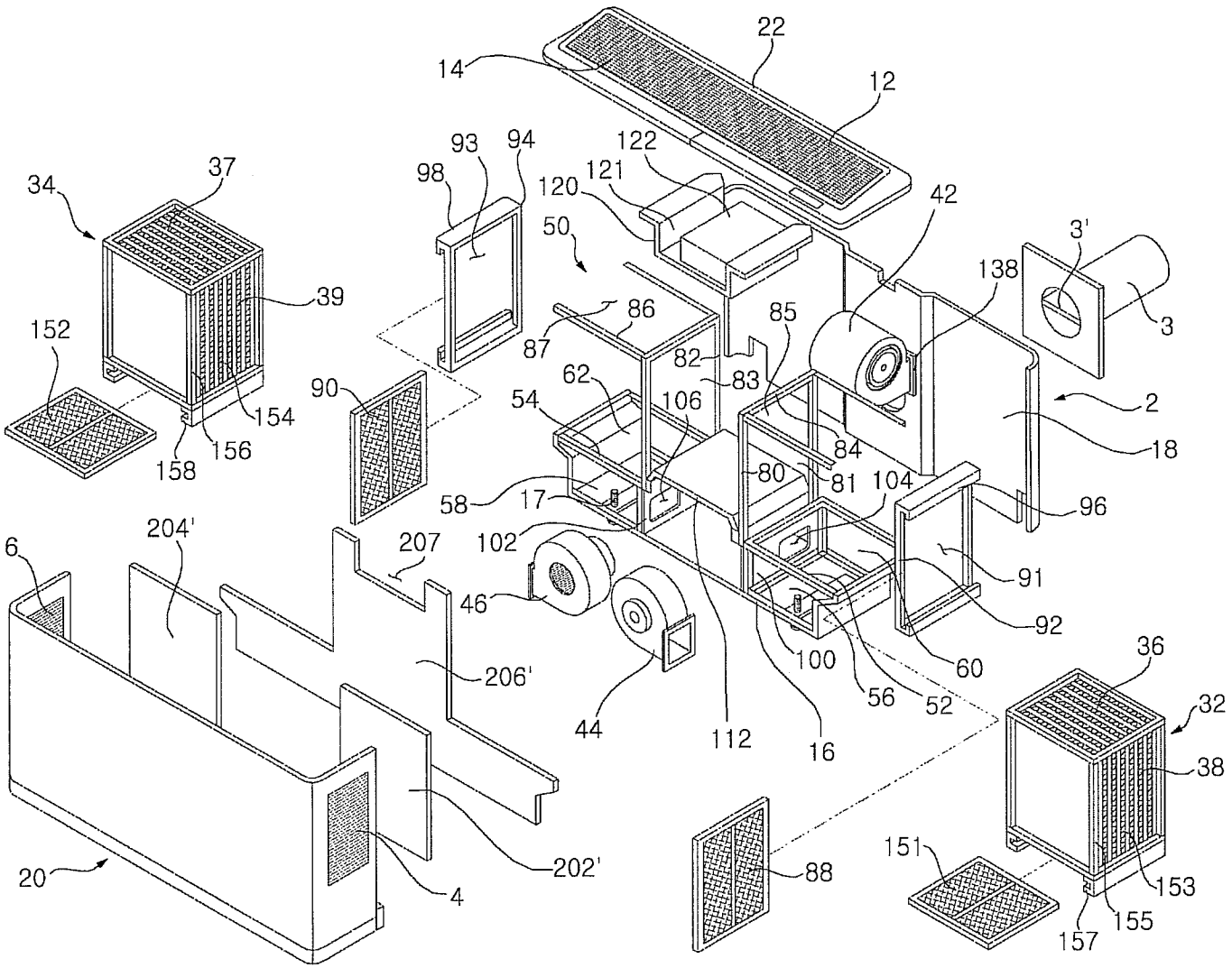
FIG. 10 is a disassembled perspective view of a ventilation apparatus in accordance with another embodiment as broadly described herein.

FIG. 10 is a disassembled perspective view of a ventilation apparatus in accordance with a fourth embodiment.

Similar to the second and third embodiments, the ventilation apparatus of the embodiment shown in FIG. 10 may include a plurality of service covers, and the plurality of service covers may include the first service covers 202', 204' and the second service cover 206'.

Similarly, the first service covers 202', 204' may be detachably coupled to the frame 50 to shield the front of the heat transfer heat exchangers 32, 34 and the exterior air filters 151, 152 together. Like the second embodiment, the first service covers 202', 204' may be detachably coupled to the frame 50 to shield the fronts of the heat exchangers 32, 34 while leaving the fronts of the exterior air filters 151, 152 exposed.

The second service cover 206' may shield the fronts of the air supply fans 44, 46, the exhaust fan 42, and the exterior air suction passages 56, 58. When the first service covers 202', 204' shield the fronts of the heat exchangers 32, 34 and do not shield the fronts of the exterior air filters 151, 152, the second service cover 206' may shield the fronts of the air supply fans 44, 46, the exhaust fan 42, the exterior air suction passages 56, 58, and the exterior air filters 151, 152.

Figure 11:
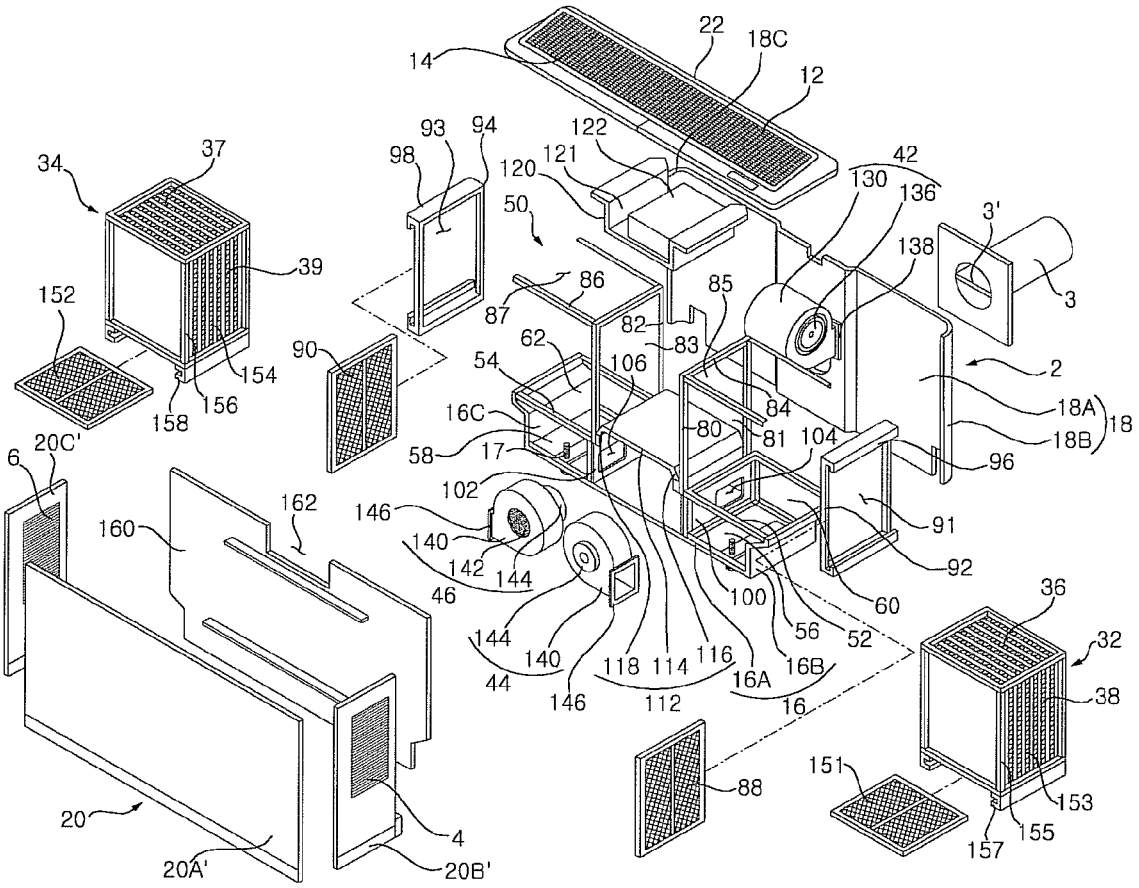
FIG. 11 is a disassembled perspective view of a ventilation apparatus, in accordance with an embodiment as broadly described herein.

In the alternative embodiment shown in FIG. 11, a frame structure is provided within the casing, the casing including a front panel including a front plate, left plate having an interior air suction port and right plate having an interior air suction port. The front plate, the left plate and the right plate may be respectively formed and assembled together. The embodiment shown in FIG. 11 includes many of the components shown in the previously described embodiments. As can be seen in FIG. 11, connection and assembly of the various frame components may be adjusted for ease of manufacture and assembly. This may also facilitate installation of the various fans and filters and access thereto.

In a ventilation apparatus in accordance with various embodiments as broadly described herein, exterior and interior air passages may be simplified, thereby simplifying structures and to enhancing efficiency. The frame may efficiently guide the movement of the interior and exterior air without hindering the interior and exterior air and adding unnecessary flow resistance while also supporting the heat transfer heat exchanger. Further, it is possible to minimize losses of interior air and exterior air that have not passed through the heat transfer heat exchanger, thereby enhancing heat exchange performance of the heat transfer heat exchanger.

Additionally, the exterior air filter and/or the interior air filter may be easily accessed for service.

In a ventilation apparatus as embodied and broadly described herein, all of an exterior side air passage and an interior side air passage may be formed horizontally, making structures of the air passage complex, with complex internal structures generating large losses.

A ventilation apparatus as embodied and broadly described herein may include a base, frames disposed in the base, a rear panel disposed in the back of the frames and formed with an interior air discharge port and exterior air suction port, a top cover disposed in the top of the frame and formed with the exterior air discharge port, a front panel disposed in the front of the frame and formed with the interior air discharge port, a heat transfer heat exchanger disposed in the frame and formed with an interior air passage and an exterior air passage, an exhaust fan moving an interior air into the interior air passage; and an air supply fan moving an exterior air into the exterior air passage, wherein the frames include a lower frame formed with an opening passing the exterior air blown from the air supply fan; a vertical frame vertical to the lower frame and formed with the opening passing the interior air moved from the interior air passage, and an upper frame disposed in the top of the vertical frame and formed with the opening passing the exterior air moved from the exterior air passage. The front panel may be formed with the interior air suction port next to the interior air passage.

The ventilation apparatus may also include an exterior air filter, disposed in the bottom of the heat transfer heat exchanger, purifying the exterior air suctioned toward the exterior air passage.

The heat transfer heat exchanger may include a plurality of heat transfer members; a heat transfer member frame supporting the plurality of heat transfer members; and an exterior air filter guide detached with the exterior air filter and disposed in the bottom of the heat transfer member frame.

The lower frame may enable the bottom surface of the heat transfer heat exchanger to space apart from the base.

The ventilation apparatus may also include an interior air filter, disposed between the interior air suction port and the interior air passage, purifying the interior air suctioned into the interior air passage.

The frame may be formed with an opening passing the interior air moved toward the interior air passage, and the ventilation apparatus may further include a filter frame detached with the interior air filter.

The ventilation apparatus may also include a service cover coupled with the frame and covering the front surface of the frame.

The ventilation apparatus may also include a first service cover detached from the frame and shielding the front of the heat transfer heat exchanger; and a second service cover detached from the frame and shielding the fronts of the air supply fan and the exhaust fan.

The first service cover may be detached from the frame not to shield the front of the interior air filter.

The first service cover may be detached to shield the fronts of the heat transfer heat exchanger and the exterior air filter together.

The frame may form the exterior air suction passage suctioned with the exterior air in the bottom surface of the heat transfer heat exchanger between the heat transfer heat exchanger and the base.

The second service cover may be disposed to shield the fronts of the air supply fan, the exhaust fan and the exterior air suction passage together.

The second service cover may be disposed to shield the fronts of the air supply fan, the exhaust fan, the exterior air suction passage and the exterior air filter together.

The ventilation apparatus may also include a third service cover disposed in the frame and shielding the front of the exterior air suction passage.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A ventilation apparatus, comprising:

a casing including an interior air suction port, an interior air discharge port, an exterior air suction port and an exterior air discharge port;

a frame structure provide in the inside of the casing;

a heat exchanger provided in the frame structure and having an interior air passage and an exterior air passage;

an exhaust fan that provides interior air to the interior air passage; and an air supply fan that provides exterior air to the exterior air passage, wherein the frame structure comprises:

a lower frame having a first opening formed therein that receives and guides exterior air from the air supply fan to the heat exchanger;

a vertical frame extending vertically with respect to the lower frame and having a second opening formed therein that receives and guides interior air from the interior air passage to the exhaust fan;

an upper frame positioned at a top of the vertical frame and having a third opening formed therein that receives and guides exterior air from the exterior air passage to the exterior air discharge port; and wherein the lower frame comprises:

a first lower horizontal frame positioned on a bottom plate of the casing;

a second lower horizontal frame spaced vertically apart from the first lower horizontal frame;

a first lower connecting frame connecting a first end of the first lower horizontal frame and a corresponding first end of the second lower horizontal frame; and a second lower connecting frame connecting a second end of the first lower horizontal frame and a corresponding second end of the second lower horizontal frame.

2. The ventilation apparatus of claim 1, wherein the interior air passage guides interior air horizontally through the heat exchanger, and the exterior air passage guides exterior air vertically through the heat exchanger.

3. The ventilation apparatus of claim 2, wherein the exhaust fan is positioned proximate the heat exchanger.

4. The ventilation apparatus of claim 1, wherein the interior air suction port is formed in the casing at a position corresponding to the interior air passage.

5. The ventilation apparatus of claim 4, wherein the heat exchanger comprises:

a plurality of heat transfer members;

a heat transfer member frame supporting the plurality of heat transfer members; and an exterior air filter guide provided at a bottom of the heat transfer member frame, wherein an exterior air filter is detachably coupled to the exterior air filter guide.

6. The ventilation apparatus of claim 1, further comprising an exterior air filter provided at a bottom of the heat exchanger to filter exterior air directed toward the exterior air passage.

7. The ventilation apparatus of claim 1, wherein the lower frame maintains a predetermined separation space between a bottom surface of the heat exchanger and the casing.

8. The ventilation apparatus of claim 7, wherein the exhaust fan is positioned next to the lower frame.

9. The ventilation apparatus of claim 1, further comprising an interior air filter provided between the interior air suction port and the interior air passage to filter interior air directed into the interior air passage.

10. The ventilation apparatus of claim 9, wherein the frame structure has an opening formed therein that guides interior air toward the interior air passage, and wherein the frame structure further comprises a filter frame to which the interior air filter is detachably coupled.

11. The ventilation apparatus of claim 10, wherein the filter frame connects the lower frame and the upper frame.

12. The ventilation apparatus of claim 1, further comprising a service cover coupled to the frame structure so as to at least partially cover a front surface of the frame structure.

13. The ventilation apparatus of claim 1, further comprising:

a first service cover detachably coupled to the frame structure so as to cover a front of the heat exchanger; and a second service cover detachably coupled to the frame structure so as to cover a front of the air supply fan and a front of the exhaust fan.

14. The ventilation apparatus of claim 13, further comprising an interior air filter positioned between the interior air suction port and the interior air passage to filter interior air flowing into the interior air passage, wherein a front end of the interior air filter is exposed when the first service cover is detached from the frame structure.

15. The ventilation apparatus of claim 14, further comprising an exterior air filter provided between the exterior air suction passage and the exterior air passage to filter exterior air flowing into the exterior air passage, wherein a front end of the exterior air filter is also exposed when the first service cover is detached from the frame structure.

16. The ventilation apparatus of claim 15, wherein both the front end of the interior air filter and the front end of the exterior air filter are covered by the first service cover when the first service cover is attached to the frame structure.

17. The ventilation apparatus of claim 13, further comprising:

an interior air filter positioned between the air suction port and the interior air passage to filter interior air flowing into the interior air passage; and an exterior air filter provided between the exterior air suction passage and the exterior air passage to filter exterior air flowing into the exterior air passage, wherein front edges of the exterior air filter and the interior air filter are covered when the first service cover is attached to the frame structure and exposed when the first service cover is detached from the frame structure.

18. The ventilation apparatus of claim 13, further comprising:

an exterior air filter provided between the exterior air suction passage and the exterior air passage to filter exterior air flowing into the exterior air passage, wherein a front edge of the exterior air filter is covered when a third service cover is attached to the frame structure and exposed when the third service cover is detached from the frame structure; and an interior air filter positioned between the air suction port and the interior air passage to filter interior air flowing into the interior air passage, wherein a front edge of the interior air filter is covered when the first service cover is attached to the frame structure and exposed when the first service cover is detached from the frame structure.

19. The ventilation apparatus of claim 13, wherein the exterior air suction passage is defined by a bottom surface of the heat exchanger, a corresponding portion of the casing, and a surrounding portion of the frame structure.

20. The ventilation apparatus of claim 19, wherein the second service cover is configured to cover fronts of the air supply fan, the exhaust fan and the exterior air suction passage together.

* * * * *